United States Patent [19]

Haas

[11] 4,290,657

[45] Sep. 22, 1981

[54] SEWING CABINET WITH VERTICALLY MOVABLE TABLE

[75] Inventor: Robert V. Haas, Edison, N.J.

[73] Assignee: The Singer Company, Stamford, Conn.

[21] Appl. No.: 118,899

[22] Filed: Feb. 6, 1980

[51] Int. Cl.[3] ..... D05B 75/00; A47B 51/00

[52] U.S. Cl. ..... 312/21; 312/22; 312/24; 312/26; 312/30; 112/217.1

[58] Field of Search ..... 312/21, 22, 24, 26, 312/27, 30, 306, 312; 112/217.1

[56] References Cited

U.S. PATENT DOCUMENTS

| | | | |
|---|---|---|---|
| Re. 28,835 | 6/1976 | Roberts et al. | 312/22 |
| 1,231,860 | 7/1917 | Deevers | 312/312 |
| 1,462,271 | 7/1923 | Ennis | 312/312 |
| 2,525,164 | 10/1950 | Ackles | 312/312 |
| 2,549,431 | 4/1951 | Crosa et al. | 312/24 |
| 2,728,621 | 12/1955 | Kempter | 312/312 |
| 3,823,993 | 7/1974 | Kakishima et al. | 312/21 |
| 3,946,682 | 3/1976 | Cowdrey et al. | 312/21 |
| 4,123,124 | 10/1978 | Peets | 312/21 |
| 4,135,463 | 1/1979 | Lacasse | 112/217.1 |
| 4,168,671 | 9/1979 | Roberts et al. | 112/217.1 |

*Primary Examiner*—Victor N. Sakran

*Attorney, Agent, or Firm*—James M. Trygg; Robert E. Smith; Edward L. Bell

[57] ABSTRACT

A sewing machine cabinet in which a sewing machine 43 can be placed in operable position, and the cabinet has as work table 17 movable between an upper position level with the bed of the machine and a lower position giving free access to the cylinder bed 44 of the machine. Support arms 54, 56, 62, 63 on the sides of the cabinet support brackets 48, 49 that carry the work table 17 in a path that moves vertically between the upper and lower positions without moving transversely to one side. Leaves 23, 24 can be attached to the ends of the work table 17 to move up and downward so as always to be at the same level as the work table to provide extra space for the work at the most convenient level. The work table 17 can be moved up and down by a hand lever 92 or foot lever 31 with a latch 37 to engage the lever to hold the work table in its upper position. A gravity operated member 85 can fall into place against a shelf 86 to hold the work table 17 in its upper position and to prevent inadvertent descent if the latch 37 that controls the lever is released at the wrong time.

13 Claims, 6 Drawing Figures

Fig.1
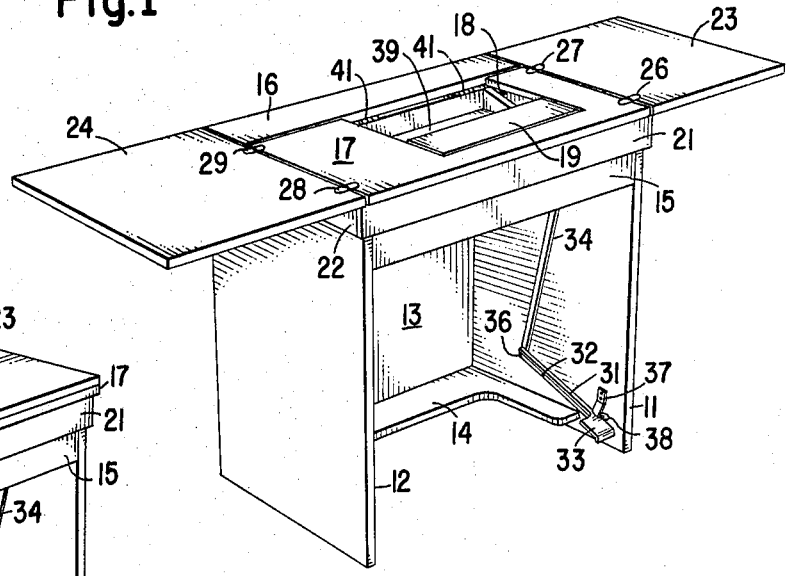
Fig.2
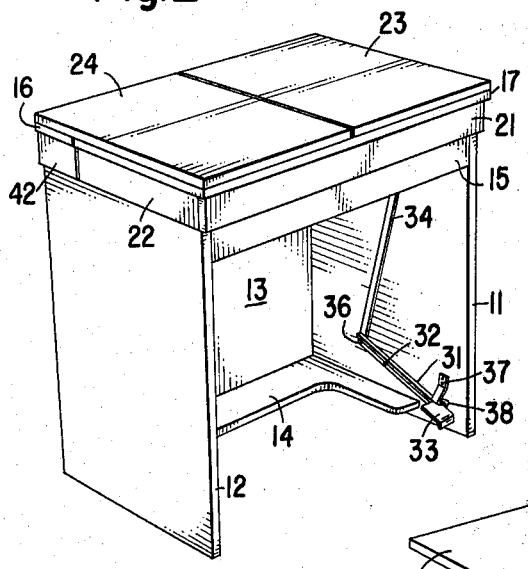
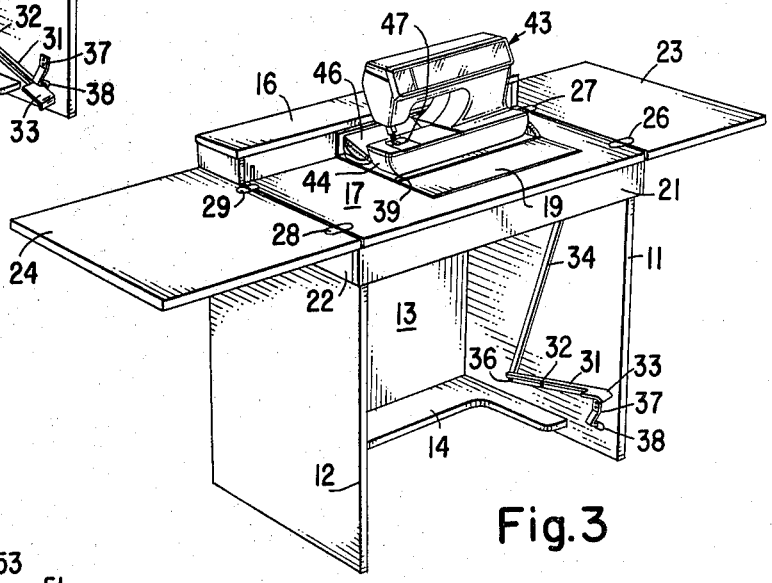
Fig.3
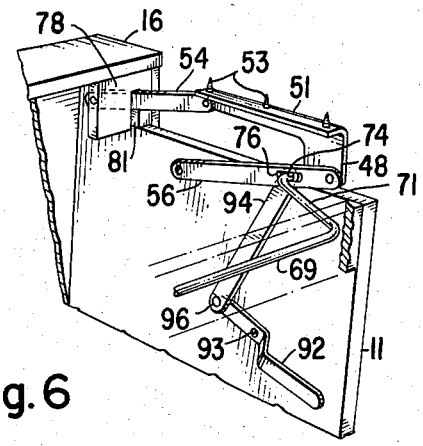
Fig.6

SEWING CABINET WITH VERTICALLY MOVABLE TABLE

BACKGROUND OF THE INVENTION

This invention relates to the field of sewing cabinets and particularly to cabinets for holding a sewing machine at a fixed height but provided with a work table extending across the front of and along the sides of the cabinet with means to hold the table in a horizontal position and to move the table without sidewise motion between an upper, flat bed position and a lower, free arm position.

The sewing machine cabinet described in U.S. Pat. No. 3,946,682 includes means for supporting a sewing machine in a fixed position and at a fixed height and for varying the height of an extension work table between a level substantially coplanar with the bed of the sewing machine and a lower position that completely exposes the cylinder bed structure of the machine. In order to shift the work table from the upper position to the lower position, it is supported on a pair of arms that pivot in a parallelogram type of movement. The axes of the pivots are perpendicular to the front of the machine, which causes the table to be shifted to the side as it is moved from one of the positions to the other. As a result, space must be left alongside the cabinet to accommodate the overhanging end of the work table due to this transverse motion. It is not always easy to provide the necessary floor space for such lateral movement, even if the cabinet is separate from other pieces of furniture.

Other cabinets suggested heretofore require that the sewing machine, rather than a work table, be moved vertically between a flat bed position and a free arm position in which the cylinder bed is exposed. Such a structure is shown in U.S. Pat. No. Re. 28,835, but it has the disadvantage that the level at which the sewing takes place, that is, the bed level and most particularly, the throat plate level, is different in the two positions, which is likely to be inconvenient for the operator, who would prefer that the location of the stitch-forming mechanisms be the same whether the machine is used as a flat bed machine or as a cylinder bed machine.

Other cabinets have provided for exposure of the cylinder bed by pivoting a thick or hollow portion of the cabinet top to one side, but such cabinets require a substantial area along side the basic structure to provide space for the pivoted portion.

OBJECTS AND SUMMARY OF THE INVENTION

It is one of the objects of the present invention to provide a sewing machine cabinet in which a work table surface can be moved between an upper and a lower position substantially vertically and without any lateral motion, thereby making it unnecessary to provide additional space alongside the cabinet to accommodate any part of the table in either of the positions.

Another object of the invention is to provide a cabinet in which a work table area extends along three sides of the machine and is movable substantially vertically between an upper position in which it forms a flat bed extension of the bed of the sewing machine and a lower position in which it exposes the cylinder bed of the sewing machine, the motion being substantially vertical and the movable work table portion of the cabinet top including at least one pivotally mounted leaf attached to move up and down with the movable work table to form a convenient work surface in either position.

Further objects will be apparent from the following specification together with the drawings.

In accordance with the present invention, a cabinet structure is provided for a sewing machine, and the structure includes support means at opposite sides of the cabinet to provide a rigid base for the machine. Commonly, the machine will be mounted on a substructure that is pivotal with respect to the rigid support structure to allow the machine to be pivoted out of sight when it is not in use.

A work table portion of the cabinet structure that extends across the cabinet structure from one side to the other and in front of the machine location and alongside the machine location is supported on brackets pivotally attached to each side of the cabinet structure to be pivoted between an upper, flat bed position and a lower, cylinder bed position. This movable table member is mounted on brackets at each end, and each of the brackets is mounted on a pair of arms. The arms of each pair are not only substantially parallel to each other and all of the same length, but the two pivot axes fixed with respect to one side of the cabinet structure are coincident with the corresponding pivot axes for the arms on the other side of the structure. The axes for the other ends of the two pairs arms where they are attached to the brackets are also coincident with each other, and both of the coincident axes are parallel to the front of the cabinet. Means are provided to apply pressure to pivot one of the arms on one side of the cabinet structure, and by the connection between that arm and the other arm on the same side connected to the same bracket, both arms on that side of the cabinet structure are pivoted. Additional means are provided to connect the pivotal mechanism on that side of the cabinet with the corresponding part of the pivotal mechanism on the other side of the cabinet to cause both of the brackets to move up and down in unison.

The means by which pressure is applied to the movable structure to lift it up and to control its rate of descent, can be a hand-operated lever or a foot-operated lever and preferably includes a spring latch to hold the lever in the position corresponding to the raised position of the work table. At least in the case of the foot lever, the spring latch should be adjacent the position at which the operator's foot engages the lever so that, in pushing the latch out of the way to free the lever to move to the alternative position, the operator's foot will inherently be in a position to hold the lever against inadvertent movement and to allow controlled movement of the lever and the work table to the alternative position, which is usually the lower position of the work table corresponding to cylinder bed operation of the machine.

In the case of a cabinet constructed to stand alone, leaves may be pivotally attached to the sides of the work table to be folded over to cover the upper surface of the cabinet completely when the machine is not in use. By mounting the leaves on the vertically movable work table and free of the stationary part of the cabinet structure, the leaves can move as an additional work area that always remains at the same level as the work table when the work table is shifted from one of its vertical positions to the other. Having a leaf at each end of the work table that moves vertically with the work table requires that the work table be arranged so that it does not move transversely from side to side as it moves vertically.

A gravity-operated, pivotally mounted member can be attached to the work table to fall into locking position when the work table is elevated to its upper position. The pivotally mounted member must be pivoted aside before the work table can be lowered to its alternative position.

BRIEF DESCRIPTION OF THE DRAWINGS

FIG. 1 is a perspective view of one embodiment of a cabinet constructed according to the invention and including side leaves attached to a vertically movable work table portion;

FIG. 2 shows the cabinet of FIG. 1 with the leaves are folded together;

FIG. 3 shows the cabinet of FIG. 1 with a sewing machine mounted on the cabinet and with the work table in position to expose the cylinder bed of the machine;

FIG. 6 is a perspective view of a fragment of an alternative embodiment of the mechanism to shift the work table between its upper and lower positions.

DETAILED DESCRIPTION OF THE PREFERRED EMBODIMENT

Figure 4:
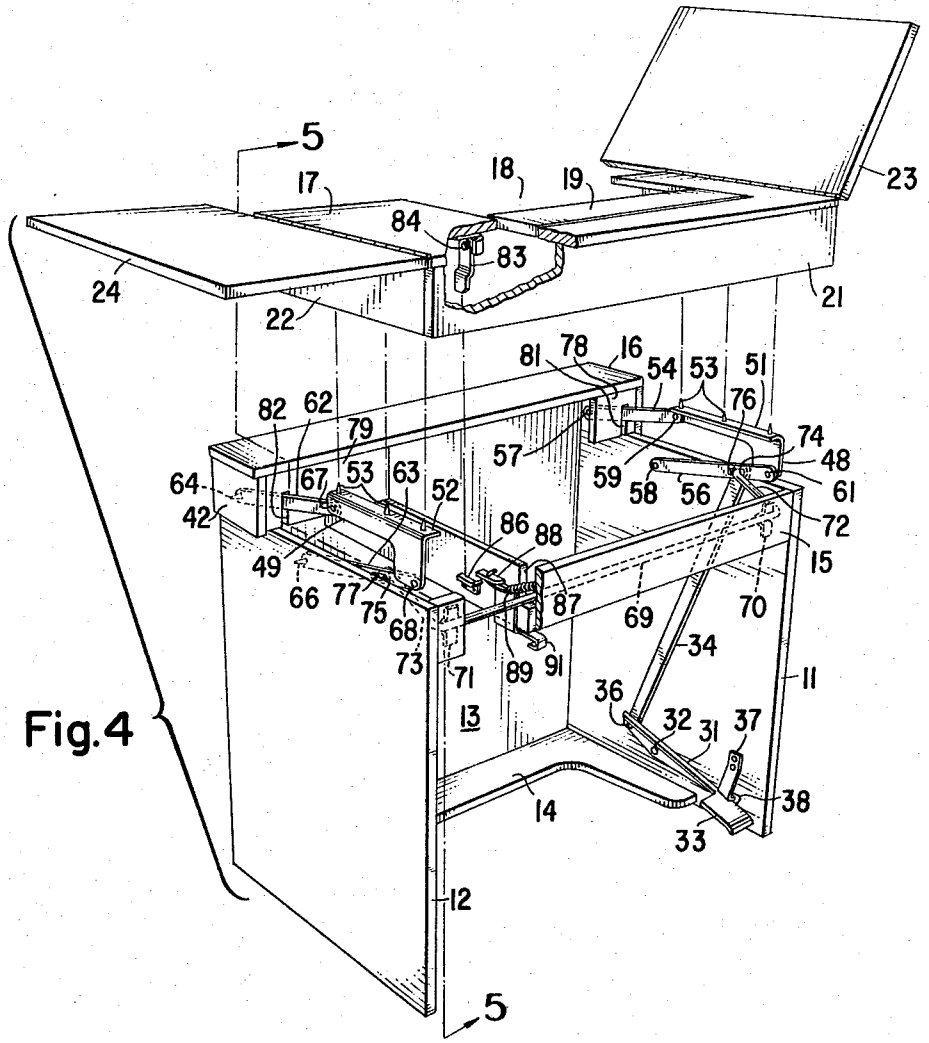
FIG. 4 is a partially exploded perspective view of the cabinet in FIG. 1 with some of the parts broken away to show the interior mechanism.

FIG. 1 shows a sewing machine cabinet with two fixed side walls 11 and 12 that furnish fixed support for the upper parts of the cabinet. The cabinet also includes a rear wall 13 that may furnish part of the fixed support and is rigidly attached to the side walls. A brace 14 at the lower part of the walls 11–13 helps to hold them in proper relationship and a board 15 is attached across the upper, front part of the side walls 11 and 12 to make the structure more rigid.

The upper part of the cabinet includes a fixed table portion 16 along the rear part of the cabinet and a movable portion, which will be referred to as a work table, 17 along the front part of the cabinet. Because the cabinet in FIG. 1 is wider, as measured from the side wall 11 to the side wall 12, than it is deep, as measured from the rear wall 13 to the front board 15, the longer dimension of the work table 17, which is referred to as the length of the work table, is the dimension in the direction perpendicular to the side walls 11 and 12.

The work table has an opening 18 into which a sewing machine may be placed and the work table extends along both sides of the opening in a generally U-shaped configuration. Part of the opening is closed by a filler piece 19, as is well known in the prior art and is shown in U.S. Pat. No. 3,946,682. A short front skirt 21 extends downwardly from the work table 17 across the front of the cabinet and at least partially covering the board 15. Side skirts, of which only the skirt 22 is shown, extend downwardly from the sides of the work table 17. In this embodiment, two leaves 23 and 24 are mounted by hinges 26–29 at the ends of the work table 17.

A foot lever 31 is mounted on a pivot 32 in the side 11 of the cabinet and has a pedal 33 conveniently located for the operator's foot. A bar 34 is attached by another pivot 36 to the rear of the lever 31, and this bar extends upwardly to means to actuate the apparatus that elevates and lowers the work table 17. The follower 31 and the bar 34 comprise a pressure means. It is important to note that the leaves 23 and 24 move with the work table 17. A spring latch 37 is attached to the side 11 and is resiliently self biased to a position such that it extends over the pedal 33, when the pedal is in the position shown, and thereby prevents the pedal from pivoting counterclockwise about the pivot pin 32. The latch 37 may be a flat strip of spring steel bent into an L shape with the lower part extending into or through an opening 38 in the side 11. The lower part of the latch 37 visible in FIG. 1, can be pressed to the right by the operator's foot in order to release the latch, but in so doing, the operator's foot will be directly over the pedal 33, which would prevent the lever 31 from pivoting counterclockwise.

The cabinet has a tray 39 on which a sewing machine may be attached. As shown in U.S. Pat. No. 3,946,682, the tray 39 is pivotally mounted on hinges 41 to permit the machine to be pivoted down out of sight when it is not in use. In order to retract the machine in this way, the filler piece 19 must be pivoted out of the way, as is well known in the prior art.

FIG. 2 shows the cabinet with the work table 17 in its upper position so as to be at the same level as the back portion 16. This permits the leaves 23 and 24 to be folded together to cover the entire top of the cabinet. These leaves are shown as being of the same size, but it is not necessary to make them that way. One of them could be larger than the other so as to cover a greater percentage of the top of the cabinet.

FIG. 2 shows a small, fixed side skirt portion 42 aligned with the side skirt 22 for the sake of appearance. The skirt portion 42 is rigidly attached to the side 12 and to the rear portion 16, and it does not move up and down with the work table 17 and the components connected thereto.

FIG. 3 shows the cabinet with the work table 17 in its lower position and with a sewing machine 43 mounted on the tray 39. This machine is of the convertible bed type, having a cylinder bed portion 44 and a pivotal plate 46 that can swing between a flat bed position and the position shown, which is the cylinder bed position.

The tray 39 supports the machine 43 at a height such that the top of the cylinder bed 44, and, in particular, the throat plate 47 is at substantially the same level as the back portion 16 of the cabinet. When the machine is being used for the type of work that requires access to the cylinder bed 44, the rear portion 16 is not likely to be used very much for supporting the work. However, the work table 17, in the lower position shown, is at the level of the horizontal surface of the tray 39 and thus is at the proper level to support the material adjacent the part actually being sewn.

One of the features of the cabinet shown in FIG. 3 is that the leaves 23 and 24 are also at the same level as the work table 17 and are not at the upper level of the fixed rear portion 16. Thus, the leaves 23 and 24 provide considerable additional surface area at the proper level to support the work.

The leaves 23 and 24 also provide additional support surfaces when the work table 17 is in its upper position, as shown in FIG. 1. In that position, the top surface of the work table 17 is in the same plane as the top surface of the rear portion 16. As stated in connection with FIG. 3, this surface of the rear portion 16 is at the same level as the upper surface of the cylinder bed 44 and the surface of the throat place 47. The hinged plate 46 would also be pivoted to the same level so that the entire surface of the leaves 23 and 24, the work table 17, the fixed rear portions 16, and the bed of the machine would all be substantially coplanar, to provide the most advantageous arrangement for flat bed sewing.

FIG. 4 shows the cabinet with the movable part separated from the fixed part. In addition, parts of the structure have been broken away to show some of the internal mechanism.

The work table 17 is supported on two brackets 48 and 49 just inside the opposite sides 11 and 12. The upper edge portions 51 and 52 of the brackets are bent over to form surfaces on which the work table 17 can rest, and several wood screws 53 pass through apertures in the flanges 51 and 52 and are screwed into the underside of the work table 17 to connect the brackets rigidly to the work table.

The bracket 48 is supported by two substantially identical arms 54 and 56 mounted on the side 11 by pivot pins 57 and 58, respectively. The arms 54 and 56 are also pivotally attached to the bracket 48 by means of pivot pins 59 and 61, respectively.

The bracket 49 is similarly supported by a pair of arms 62 and 63 that are identical with the arms 54 and 56, respectively, and are mounted on the inner surface of the side 12 by pivot pins 64 and 66 that are axially aligned with the pins 57 and 58, respectively. The other ends of the arms 62 and 63 are pivotally attached to the bracket 49 by means of pivot pins 67 and 68, which are exactly aligned with the pivot pins 59 and 61, respectively. Thus, it is possible for the brackets 48 and 49 to traverse identical paths as the arms 54, 56, 62, and 63 are pivoted up and down. Because the arms are equal in length, their motion is of a parallelogram type. By suitably locating the axis on which the pins 57 and 64 are located with respect to the axis on which the pins 58 and 66 are located, the plane of the flanges 51 and 52 can be kept horizontal over the entire range of positions of the brackets 48 and 49.

In order to be certain that the planes of the flanges 51 and 52 are not only horizontal but are at the same height, a round rod 69 is mounted on the rear side of the front board 15 and is attached to corresponding points on the arms 56 and 63. The rod 69 is pivotally supported on the board 15 by a pair of brackets 70 and 71 near opposite ends of a straight central portion of the rod and near the side walls 11 and 12. Beyond the brackets 70 and 71 the ends of the rod 69 are bent at approximately right angles to the central portion to form a pair of lever arms 72 and 73. The outermost ends 74 and 75 of these arms are bent outwardly to be substantially parallel with the central portion of the rod 69 so as to extend through notches 76 and 77 in the arms 56 and 63, respectively. In addition, the end 74 of the arm 72 extends through a hole in the end of the bar 34 so that any movement of the bar is directly connected through the arm 72 to the rod 69 and to the other arm 73. The notches 76 and 77 are required because the center of pivotal movements of the arms 56 and 63 are not concentric with the center of pivotal movement of the arms 72 and 73.

A pair of filler plates 78 and 79 are rigidly attached to opposite ends of the fixed table portion 16 and to the side walls 12 and 11, respectively. These filler plates help strengthen the cabinet structure, but they are in the paths of movements of the arms 54 and 62. Therefore, slots 81 and 82 have been cut into the plates 78 and 79 to allow the arms 54 and 62 to move to their uppermost positions.

A member 83 is mounted on a pivot 84 on the underside of the work table 17 and is shown in the position to which it would naturally fall under the force of gravity. This position brings it directly over a shelf 86 rigidly supported on a frame member 87 attached to the back wall 13 and to the board 15. The length of the member 83 is such that, when the work table 17 is in its upper position level with the fixed portion 16, the lowermost tip of the member 83 will rest on the shelf 86 and prevent the work table 17 from falling, no matter whether the latch 37 is pressed inwardly or not.

In order to push the member 83 out of the way so as to be able to lower the work table 17, a slider 88 is attached to the frame member 87. A spring 89 draws the slider 88 away from the member 83 so as not to interfere with the normal pivoting of the member 83 into the position shown when the work table 17 is moved to its upper position. A pressure knob 91 is attached to the slider 88. When the pressure knob 91 is pressed directly inward, it pushes the end of the slider against the front side of the member 83 and pivots the lowermost end of that member away from the shelf 86. If, at the same time, the latch 37 is pressed inwardly, the work table 17 can be lowered, but pressure on either the member 83 or the latch 37, alone, will not leave the work table 17 free to fall to its lower position accidentally.

Figure 5:
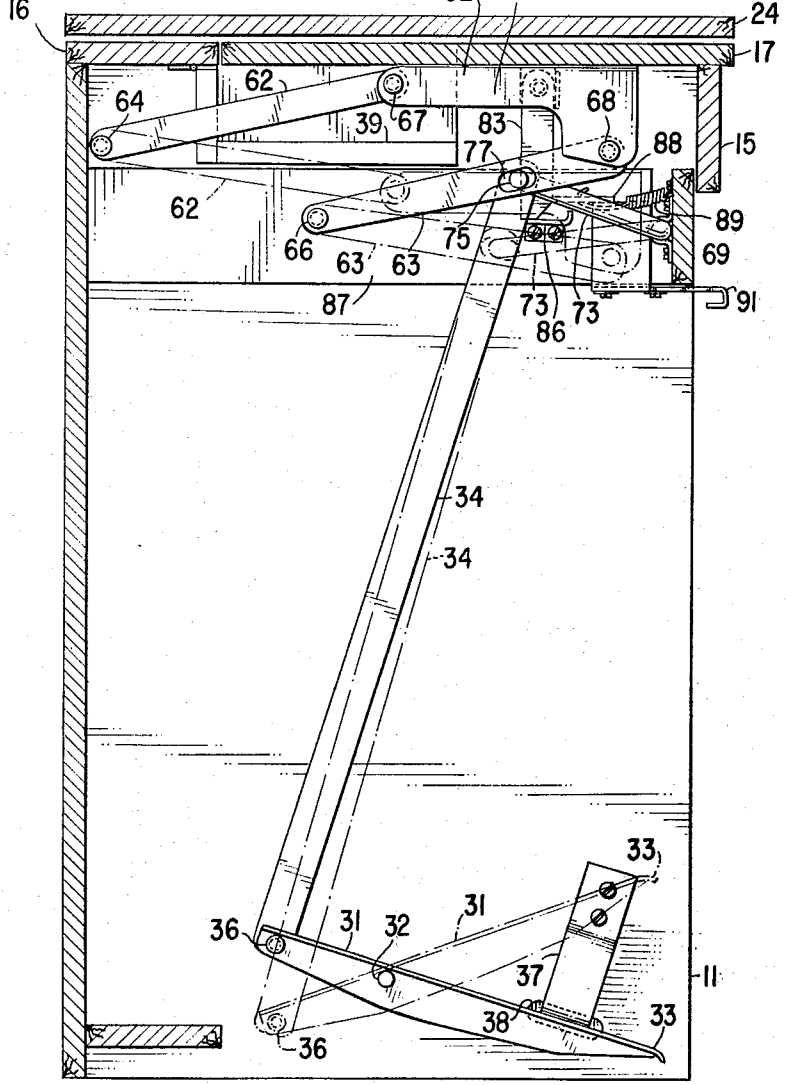
FIG. 5 is a cross sectional side view of the cabinet along the line 5—5 in FIG. 4.

FIG. 5 shows a cross sectional view of the cabinet just inside the side wall 12. This view shows the arms 62 and 63 and the bracket 49 in full lines in their upper position. It also shows these same components in broken lines in their lower position. In order to keep the arms 62 and 63 separated in the lower position, the pivot 64 and 66 are vertically separated with the pivot 64 being above the level of the pivot 66. The pivots 67 and 68 are also at different vertical levels to allow the arms 62 and 63 to carry out the necessary parallel pivoting movement, and the pivot 68 is lower than the pivot 67 by the same amount as the pivot 66 is lower than the pivot 64.

The member 83 is shown in the position to which it falls under the force of gravity when the work table 17 is in the upper position. The tip of the member 83 rests on the shelf 86 directly in the path of the slider 88 by which the member 83 can be pivoted away from the shelf.

The arm 74 of the rod 69 is shown in full lines in its upper position and broken lines in its lower position. Correspondingly, the bar 34 and the lever 31 are also shown in full lines in the position that they would occupy when the work table 17 and the arms 62, 63 and 74 are in their upper positions. The bar 34 and the lever 31 are shown in broken lines in the positions they would occupy when the table 17 and the arms 62, 63, and 74 are in their respective lower positions. Each of the pivots 64 and 66 moves along an arcuate path, so that the front edge of the work table 17 also follows a matching arcuate path. Thus, the work table does not move along a straight, vertical path as it moves between its upper and lower positions. Its path projects very slightly forward but not at all transversely. The projection is minimized by locating the axis of the pivot 64 midway between the position of the axis of the pivot 67 when the work table 17 is in its upper position with its upper surface coplanar with the upper surface of the fixed portion 16 and the position of the axis of the pivot 67 when the work table is in its lower position in which its upper surface is coplanar with the upper surface of the tray 39 with the latter in its horizontal position. The axes of the pivots 57 and 59 are, as previously indicated, coincident with the axes of the pivots 64 and 67. The axes of the arms 63 and 56 are located so as to keep those arms paralleled at all times to the arms 62 and 54. In order to avoid having to cut slots in the rear edge of the work table 17 to accommodate the upper arms 52 and 54, the pivots 64, 68, 57, and 58 may be placed slightly lower than the ideal positions just defined.

FIG. 6 shows only a small part of the cabinet to illustrate an alternative actuating member. Instead of the foot-operated lever shown in the other figures, the cabinet in FIG. 6 includes a hand-operated lever 92 mounted on a pivot 93. In order to be within reach of an operator, the lever 92 is higher than the lever 31 would be, and so a bar 94 shorter than the bar 34 in FIG. 1 is used. The bar 94 is pivotally connected by a pin 96 to the end of the lever 92. In this embodiment, there is no latch corresponding to the latch 37 in FIG. 1, but the gravity operated member 83 shown in FIGS. 4 and 5, can be used to hold the work table attached to the bracket 48 in its upper position level with the fixed portion 16.

While this invention has been described in terms of specific embodiments, it will be understood by those skilled in the art that modifications may be made therein within the scope of the invention as defined by the following claims.

I claim:

1. A cabinet structure comprising:

first and second side support members spaced apart a fixed distance;

a work table extending transversely between the first and second side members and movable vertically between an upper position and a lower position;

a first bracket to support one end of the work table;

a second bracket to support the other end of the work table;

a first pair of support arms each comprising a first end pivotally attached to the first support member and a second end pivotally attached to the first bracket, the arms being pivotally moving substantially parallel to each other;

a second pair of support arms substantially the same length as the first pair of arms, respectively, and each comprising a first end pivotally attached to the second support member and a second end pivotally attached to the second bracket, the arms of the second pair being pivotally movable substantially parallel to each other;

pressure means connected to the arms of the first pair to pivot the first pair of arms between first positions in which the first bracket supports one end of the work table in its upper position and a second position in which the first bracket supports said one end of the work table in its lower position;

connecting means connecting the arms of the first pair with the arms of the second pair to pivot the arms of the second pair simultaneously with the arms of the first pair to support the other end of the work table in corresponding upper and lower positions; and latching means to hold both of the brackets in a position in which the table means is elevated to its upper position.

2. The cabinet structure of claim 1 in which all of the arms are parallel to each other and of equal length, and one of the arms of each pair is closer to the front of the cabinet structure than the other of the arms of the same pair and the pivot axes of the arms closer to the front of the cabinet are lower than the pivot axes of the other of the arms of the same pair.

3. The cabinet structure of claim 1 in which the connecting means engages a corresponding arm of each of the pairs.

4. The cabinet structure of claim 3 in which the connecting means comprises:

a rod extending substantially from one side of the cabinet to the other along a first axis;

first and second connecting arms rigidly attached at opposite ends of the rod; and means extending from the first and second connecting arms to a corresponding one of the support arms of the first and second pair of support arms, respectively.

5. The cabinet structure of claim 4 in which the pressure means is connected to the first connecting arm to be connected thereby to a first one of the arms of the first pair of support arms and to be connected by the rod and the second connecting arm to the corresponding arm of the second pair of support arms, the other support arm of each of the pairs of support arms being simultaneously pivoted between first and second positions through interconnection by the first and second brackets.

6. The cabinet structure in claim 5 in which the latching means engages the pressure means to hold both of the brackets in a position in which the work table is elevated to its upper position.

7. The cabinet structure of claim 6 in which the pressure means comprises:

a lever pivotally mounted on the first side support member; and a bar having one end pivotally connected to the lever and the other end pivotally connected to one of the support arms of the first pair of support arms.

8. The cabinet structure of claim 7 in which the bar is connected to the first connecting arm and thereby connected to the first arm of the first pair of support arms.

9. The cabinet structure of claim 1 comprising, in addition:

a gravity operated member pivotally supported on the underside of the work table to hang down therefrom;

a shelf below the pivotally mounted member and rigidly attached to the side support members, whereby the lower side of the pivotally mounted member can normally rest on the shelf when the work table is in its elevated position; and release means movably mounted relative to the support members to engage the pivotally mounted member to move the pivotally mounted member from engagement with the shelf to allow the work table to be moved down to its lower position.

10. The cabinet structure of claim 1 comprising, in addition, a leaf pivotally mounted to one end of the work table to be folded between a first position covering at least part of the work table and a second position substantially coplanar with the work table and extending from one end thereof to be moved with the work between the first and second positions.

11. The cabinet structure of claim 10 comprising, in addition, a fixed table portion rigidly connected to the first and second side support members and extending transversely between the first and second side members behind the work table, the fixed table portion having a tray pivotally attached thereto to support a sewing machine at a level such that the upper surface of the bed of the machine is substantially coplanar with the upper surface of the fixed table portion and with the upper surface of the work table when the work table is in its upper position.

12. The cabinet structure of claim 11 in which the lower position of the upper surface of the work table is substantially coplanar with the upper surface of the tray when the upper surface of the tray is in it horizontal position.

13. The cabinet structure of claim 12 in which the first end of each of the support arms is pivotally attached to the respective support member at a height substantially midway between the heights of the pivotal attachment between the respective arm and its respective bracket when the work table is in its upper and lower positions.

* * * * *